US006808793B2

(12) United States Patent
Randall et al.

(10) Patent No.: US 6,808,793 B2
(45) Date of Patent: Oct. 26, 2004

(54) PRE-COATED MAT-FACED GYPSUM BOARD

(75) Inventors: Brian G. Randall, Lawrenceville, GA (US); Gary A. Ricards, Peachtree City, GA (US)

(73) Assignee: G-P Gypsum Corporation, Atlanta, GA (US)

( * ) Notice: Subject to any disclaimer, the term of this patent is extended or adjusted under 35 U.S.C. 154(b) by 0 days.

(21) Appl. No.: 10/369,593

(22) Filed: Feb. 21, 2003

(65) Prior Publication Data

US 2003/0203191 A1 Oct. 30, 2003

Related U.S. Application Data

(63) Continuation of application No. 09/837,226, filed on Apr. 19, 2001.

(51) Int. Cl.[7] ..... B32B 13/00; B32B 5/26; B32B 27/12

(52) U.S. Cl. ..... 428/219; 428/220; 428/703; 442/283; 442/284; 442/285; 442/288; 442/290

(58) Field of Search ..... 428/294.7, 297.4, 428/299.4, 703, 219, 220; 442/17, 19, 29, 43, 44, 45, 58, 60, 76, 78, 79, 85, 180, 290, 288, 285, 284, 283

(56) References Cited

U.S. PATENT DOCUMENTS

| | | | | | |
|---|---|---|---|---|---|
| 3,455,710 | A | * | 7/1969 | Nitzsche | 106/781 |
| 3,623,895 | A | * | 11/1971 | Nitzsche | 106/2 |
| 3,824,147 | A | | 7/1974 | Baird | |
| 3,876,968 | A | * | 4/1975 | Barnes et al. | 338/211 |
| 3,935,021 | A | | 1/1976 | Greve et al. | |
| 3,945,965 | A | * | 3/1976 | Ramig et al. | 523/218 |
| 3,947,398 | A | | 3/1976 | Williams | |
| 3,993,822 | A | | 11/1976 | Knauf et al. | |
| 4,136,687 | A | * | 1/1979 | Dabroski | 602/8 |
| 4,265,979 | A | | 5/1981 | Baehr et al. | |
| 4,303,722 | A | | 12/1981 | Pilgrim | |
| 4,378,405 | A | | 3/1983 | Pilgrim | |
| 4,447,498 | A | * | 5/1984 | Fink et al. | 428/447 |
| 4,494,990 | A | | 1/1985 | Harris | |
| 4,504,533 | A | | 3/1985 | Altenhofer et al. | |
| 4,572,861 | A | | 2/1986 | Barretto Garcia et al. | |
| 4,643,771 | A | * | 2/1987 | Steinbach et al. | 106/678 |
| 4,647,496 | A | | 3/1987 | Lehnert et al. | |
| 4,784,897 | A | | 11/1988 | Brands et al. | |
| 4,876,142 | A | | 10/1989 | Piccirillo | |
| 4,916,004 | A | | 4/1990 | Ensminger et al. | |
| 5,001,005 | A | | 3/1991 | Blanpied | |
| 5,102,728 | A | | 4/1992 | Gay et al. | |
| 5,112,678 | A | | 5/1992 | Gay et al. | |
| 5,342,680 | A | | 8/1994 | Randall | |
| 5,395,685 | A | | 3/1995 | Seth et al. | |
| 5,397,631 | A | | 3/1995 | Green et al. | |
| 5,484,653 | A | * | 1/1996 | Kennedy et al. | 442/415 |
| 5,718,785 | A | | 2/1998 | Randall | |
| 5,965,257 | A | | 10/1999 | Ahluwalia | |
| 5,981,406 | A | | 11/1999 | Randall | |
| 2002/0155282 | A1 | * | 10/2002 | Randall et al. | 428/341 |

FOREIGN PATENT DOCUMENTS

| | | |
|---|---|---|
| GB | 2 022 503 A | 12/1979 |

* cited by examiner

*Primary Examiner*—Paul Thibodeau
*Assistant Examiner*—Kevin R. Kruer
(74) *Attorney, Agent, or Firm*—Banner & Witcoff, Ltd.

(57) ABSTRACT

A moisture-tolerant structural panel comprising a gypsum board comprising a set gypsum core sandwiched between and faced with mats of glass fibers, wherein a free surface of one of said mats is coated with a combination of a mineral pigment, an inorganic adhesive binder and a polymer latex adhesive binder applied to said surface as an aqueous coating composition, said aqueous coating composition upon drying and setting, covering said mat to the extent that substantially none of the fibers of said mat protrude from said coating.

20 Claims, 1 Drawing Sheet

PRE-COATED MAT-FACED GYPSUM BOARD

CROSS-REFERENCE TO RELATED APPLICATIONS

This application is a continuation application of U.S. Ser. No. 09/837,226, filed Apr. 19, 2001.

FIELD OF THE INVENTION

This invention relates to an improved fibrous mat-faced gypsum board, for example, gypsum board faced with glass fiber mat. More particularly, the present invention relates to a gypsum board faced with a coated glass fiber mat. The coating comprises a dried aqueous mixture of a mineral pigment; a first binder comprised of a polymer latex adhesive; and, a second binder comprised of an inorganic adhesive.

The present invention is particularly advantageous for use in any application in which the fibrous mat-faced gypsum board is expected to be exposed to a high humidity or high moisture environment during installation or use, such as in shaft walls, stairwells, area separation walls, return air installations and as a tile backer in bathroom applications. Still other applications and uses will become apparent from the detailed description of the invention, which appears hereinafter.

BACKGROUND OF THE INVENTION

Panels of gypsum wallboard which comprise a core of set gypsum sandwiched between two sheets of facing paper have long been used as structural members in the fabrication of buildings where the panels are used to form the partitions or walls of rooms, elevator shafts, stairwells, ceilings and the like. A specialty application for the use of panels of gypsum wallboard, as well as other types of building panels, is the use thereof in bathrooms—typically a place of high humidity and residual water because of the flow of water from the use of showers, bathtubs, and sinks. Gypsum wallboards suitable for use in these applications share a common requirement; that is a resistance or tolerance to high humidity and high moisture environments, often for prolonged periods.

A usual construction of bathroom walls includes a multi-ply structure of ceramic tile adhered to an underlying base member, for example, a panel of wallboard comprising gypsum or other material as will be described below. Such a panel is referred to in the industry as a "tile backing board," which for convenience is referred to herein as "tile backer". In usual fashion, sheets of tile backer (for example, 4'×8'×½") are fastened by rust-resistant nails or screws to studs. Blocks of ceramic tiles (for example, 4"×4") are adhered to the sheets of tile backer by water-resistant adhesive which is referred to in the industry as "mastic" or by a Portland cement-based adhesive which is referred to commonly as "thin set mortar". Thereafter, spaces between the tiles and between the tiles and other adjoining surfaces, for example, the lip of a bathtub or sink, are filled with a water-resistant material which is referred to in the industry as "grouting".

It should be appreciated that a primary goal in constructing a bathroom that includes one or more of a bathtub, shower and sink is to make the contiguous and adjacent walls water-tight utilizing materials that resist being degraded by water, including hot water. Tiles made from ceramics are such materials and are basically inert to both the hot and cold water with which the tiles come into direct contact.

It is important also that the tile backer to which the tiles are adhered be water-resistant. Theoretically, it would seem that the water-resistant properties of the tile backer should be inconsequential because the backer is shielded from shower, bath and sink water by water-resistant tiles, grouting and mastic. However, experience has shown this is not the case and that moisture can and does in fact seep through the plies of material which overlie the tile backer. This can happen in various ways.

One way has to do with the fact that grouting is not water-impervious and over time permits the seepage of moisture, a situation which is aggravated upon the formation of cracks, including hairline cracks, in the grouting. Eventually, the moisture which penetrates through the grouting finds its way through the mastic and comes into contact with the paper facing of the wallboard. Such paper facing is typically a multi-ply paper, which upon contact with moisture tends to degrade by delaminating or otherwise deteriorating. For example, the paper facing is subject to biological degradation from mold and mildew. The paper can actually rot away. Furthermore, as the moisture comes into contact with the underlying set gypsum core, it tends to dissolve the set gypsum and also the core adhesive, which bonds the core and paper facing together. Such adhesive is typically a starch material. The development of these conditions can lead to tiles coming loose from the underlying deteriorated paper-faced gypsum wallboard. This undesirable situation is exacerbated when hot water comes into contact with the paper-faced wallboard.

Another type of moisture condition which leads to the loosening or falling off of tiles from their underlying support substrate is associated with those segments of the multi-ply wall structure which include a joint formed from an edge portion of the wallboard. An example is the joint formed by the edge of a wallboard panel and the lip of a bathtub. Another example is the joint formed by two contiguous wallboard panels. As moisture penetrates through the multi-ply structure and reaches such a joint, it tends to wet significant portions of the paper facing and core by virtue of its spreading through capillary action. This can lead to delamination of the paper facing and/or dissolution of the core and/or the paper/core adhesive. As this occurs, tiles can come loose and fall off.

The present invention relates to the provision of an improved gypsum-based structural panel of the type which can be used effectively as a tile backer and in other applications such as in the return air installations, shaft walls and area separator walls in commercial buildings where water and humid conditions are commonly encountered. Still other applications where moisture and humid conditions are likely to present difficulties with paper-faced gypsum board either during the installation or the use of the board will be apparent to those skilled in the art.

In efforts to mitigate or overcome problems associated with the use of paper-faced gypsum wallboard in applications where moisture exposure is expected to occur, the prior art has approached the problem in various ways over the years.

One approach to the problem has been to treat the paper comprising the facing of the wallboard with a water-resistant material sometimes referred to as a water-repellant. Polyethylene emulsion is an example of a material that is used to treat paper facing to impart water-resistant characteristics. Such treatment is designed to deter delamination of the multi-ply paper facing by reducing the tendency of the paper to absorb water which is a chief cause of delamination and to deter water from penetrating through the paper to the gypsum and destroying the bond between the paper-facing and gypsum core.

Another approach to the problem has involved incorporating into the formulation from which the gypsum core is made a material that functions to impart improved water-resistant properties to the set gypsum core itself. Such an additive tends to reduce the water-absorbing tendency of the core and decrease the solubility characteristics of the set gypsum. Wax-asphalt emulsions and wax emulsions are examples of such an additive.

Although improvements have been realized by the provision of gypsum wallboard prepared in accordance with these teachings, further improvements are still possible. Over a period of time, experience shows that tiles come loose from tile backer of boards having treated-paper facers, as the paper facing delaminates and the gypsum core erodes through the degrading action of moisture. The problem is particularly aggravated by warm water acting upon a gypsum core that includes either a wax emulsion or a wax-asphalt emulsion, commonly used, water-resistant core additives. While cores containing such materials have quite good water-resistant characteristics in the presence of water at room temperature, such characteristics start to fall off at temperatures in excess of 70° F. and tend to disappear in the presence of water having a temperature of about 100° F. or higher.

Still another approach to the problem is exemplified in commercially available structural panels comprising a Portland cement-based core sandwiched between facings of woven glass mat treated with a resinous material such as poly(vinyl chloride). The cement constituent of such products is more water-resistant than set gypsum, but such cement-based panels have a relatively high weight, and accordingly, are difficult to handle and expensive to ship. It is known to include expanded polystyrene in the cement-based core to reduce the weight, but even such lower weight panels are heavy enough to be unwieldy, weighing about 3000 to about 3500 lbs. per 1000 sq. ft.

In another approach, U.S. Pat. No. 4,647,496 discloses a structural panel comprising a water-resistant set gypsum core sandwiched between two porous fibrous mats. The preferred form of mat is described as a glass fiber mat formed from fiberglass filaments oriented in random pattern and bound together with a resin binder. Such panels differ from conventional gypsum wallboard in that the fibrous mat is substituted for paper as the facing materials of the gypsum core. Extensive outdoor testing has shown that glass mat-faced, water-resistant gypsum board of the type described in the aforementioned '496 patent has much better weathering characteristics, including water-resistant characteristics, in outdoor applications than water-resistant gypsum board covered with water-resistant paper facing. However, prior evaluations conducted with such glass mat-faced board as a tile backer has revealed problems not unlike those encountered with the use of water-resistant board faced with water-resistant paper. Although glass mat has no tendency to delaminate like multi-ply paper, there is a tendency for moisture to dissolve and erode the gypsum of the glass mat-faced board. As this occurs, mastic with tile adhered thereto pulls away from the gypsum core. The loosened tile can eventually fall away from the wall.

Another more recent development in the water-resistant gypsum board field is described in U.S. Pat. No. 5,397,631. According to this patent, a fibrous mat-faced gypsum board is coated with a substantially humidity- and water-resistant resinous coating containing a latex polymer. The coating, which acts as both a liquid and vapor barrier, is formed from an aqueous coating composition comprising from about 15 to about 35 wt. % of resin solids, about 20 to about 65 wt. % of filler, and about 15 to about 45 wt. % of water, applied to obtain a solids loading of about 110 lbs. per 1000 sq. ft. A preferred resin for use according to this patent is a latex polymer which has been sold by Unocal Chemicals Division of Unocal Corporation under the mark 76 RES 1018. The resin is a styrene-acrylic copolymer that has a relatively low film-forming temperature. Coatings formed from the resin can be dried effectively at temperatures within the range of about 300° to 400° F. If desired, a coalescing agent can be used to lower the film-forming temperature of the resin. While this approach satisfactorily solves many of the previous-mentioned problems, the high cost of the resinous coating and the adverse impact that the coating has on the flame spread characteristics of the coated board has been an impediment to wider use.

The present invention is related to the provision of an improved, coated fibrous mat-faced gypsum board having a predominantly inorganic coating on the mat.

In accordance with the present invention, there is provided a moisture tolerant structural panel comprising a fibrous mat-faced gypsum board wherein the outer surface of the mat is coated with a coating which comprises a mineral pigment (pigmented filler material), an inorganic binder and a latex polymer binder. In particular, the coating comprises a dried (or cured) aqueous mixture of a mineral pigment; a first binder of a polymer latex adhesive and, a second binder of an inorganic adhesive. On a dry weight basis, the first polymer latex binder comprises no more than about 5.0% by weight of the coating, and the second inorganic binder comprises at least about 0.5% by weight, of the total weight of the coating. The second binder preferably comprises an inorganic compound such as calcium oxide, calcium silicate, calcium sulfate, magnesium oxychloride, magnesium oxysulfate, or aluminum hydroxide. In one embodiment, the second binder is included as an inherent component in the mineral pigment, as in the case wherein the mineral pigment includes aluminum trihydrate, calcium carbonate, calcium sulfate, magnesium oxide, or some clays and sands. The ratio, by weight, of the mineral pigment to the polymer latex adhesive in the coating is generally in excess of 15:1.

BRIEF DESCRIPTION OF THE DRAWINGS

The objects, features, and advantages of the invention will be apparent from the following more detailed description of certain embodiments of the invention and as illustrated in the accompanying drawings in which reference characters refer to the same parts throughout the various views. The drawings are not necessarily to scale, emphasis instead being placed upon illustrating the features of the invention.

DETAILED DESCRIPTION OF THE INVENTION

Figure 1:
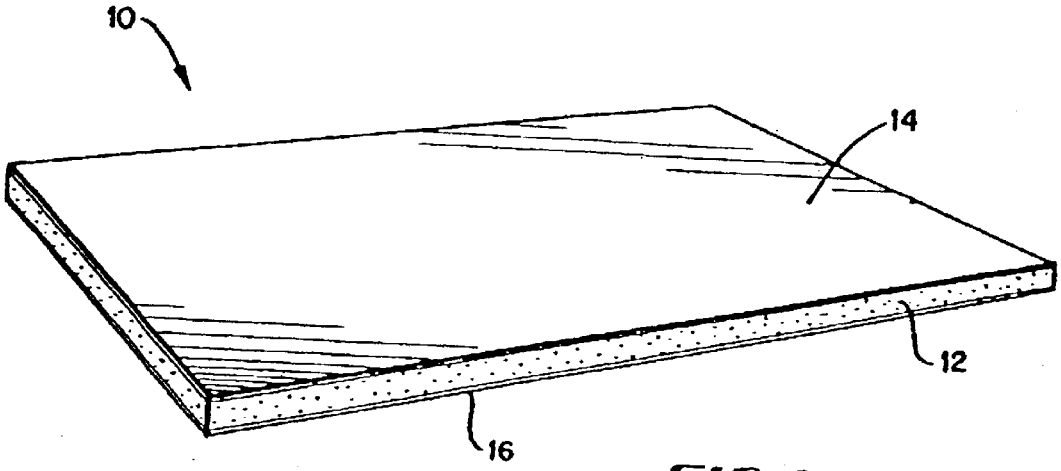
FIG. 1 is an isometric view of a moisture tolerant panel comprising a coated glass mat faced gypsum board of the invention.
Figure 2:
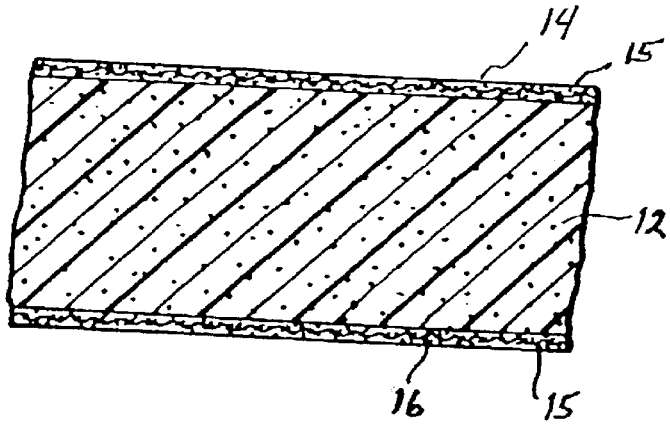
FIG. 2 is a cross-sectional view of the moisture tolerant panel of FIG. 1.

As shown in FIG. 1, the moisture-tolerant structural panel of the present invention 10 comprises a gypsum board core 12 faced with two fiber mats, 14 and 16, preferably both are glass fiber mats. The surface of at least one of the mats is coated with a dried (heat cured) coating (indicated by the numeral 15 in FIG. 2) of an aqueous coating composition containing a combination (e.g., a mixture) of a mineral pigment; a first binder of a polymer latex adhesive and, a second binder of an inorganic adhesive. The coated fiber mat used in the invention can be prepared by applying an aqueous coating composition containing the noted solid constituents to a fiber mat in an amount on a dry weight basis equivalent to at least about 50 lbs., more usually between about 60 and 120 lbs., per 1000 sq. ft. of mat. Normally, the dry coating is present in an amount equivalent to at least about 60 lbs., most often between about 80 and 100 lbs., per 1000 sq. ft. of mat, depending upon the thickness of the glass fiber mat. The core of the gypsum board also preferably includes a water-resistant additive, and the coated mat-faced board has a weight equivalent of no greater than about 2500 lbs. per 1000 sq. ft. of board surface area (for a ½" board).

There are numerous advantages associated with the use of the present invention. Of primary importance is that the coated fiber mat-faced board has superior weathering characteristics, and accordingly, can be used effectively for indefinite periods of time as a stable substrate in applications involving water contact and high humidity exposure, either in the initial installation of the board or during its use. A coated glass mat-faced board of the present invention is mold- and rot-resistant, which distinguishes it from paper-faced boards, which in the presence of moisture tend to degrade by virtue of mold growth and rotting. In addition, a coated glass mat-faced board within the present invention is relatively light in weight compared to Portland cement products. For example, an exemplary coated glass mat-faced board within the scope of the present invention (½" thick board) can be made at a weight of about 2 lbs. per sq. ft., whereas Portland cement-based boards are at least about 50% heavier. It is noted also that although such cement-based boards are water-resistant, they, nevertheless, are water-absorbing. Inasmuch as water can penetrate through the board and come into contact with wooden or metal supports, it is recommended that a non-water-absorbing plastic sheet be installed between the back of the board and the supports. This helps to protect the supports from being degraded by water. In accordance with the present invention, it is usually not necessary to use such materials in that water is substantially prevented from passing through the coated board to the backside thereof.

The coated glass mat-faced board of the invention can be scored and cut more easily than cement-based board and because of its lighter weight, it can be made in larger size sheets.

In addition to providing improved performance under high humidity conditions, the fire resistance of glass fiber mat-faced gypsum board of the present invention also is significantly enhanced by coating the face of the board with the primarily inorganic coating of this invention. This is especially significant because water resistant wall assemblies in commercial buildings are often located along party walls between occupants, often to allow for common plumbing lines between the walls. Such walls usually fall under building code regulations that call for fire resistive construction.

In order to achieve the required fire protection with Portland cement wallboard, the cavity between the walls usually must contain mineral wool, and the exterior wall surfaces must be completely tiled. This introduces extra expense. In order to meet building code requirements with gypsum board, a special fire rated ⅝th inch thick board usually must be used, and the resultant wall assembly is still vulnerable to water.

The gypsum core of the moisture tolerant structural panel of the present invention is basically of the type used in those gypsum structural products, which are known as gypsum wallboard, dry wall, gypsum board, gypsum lath and gypsum sheathing. The core of such a product is formed by mixing water with powdered anhydrous calcium sulfate or calcium sulfate hemi-hydrate ($CaSO_4.1/2H_2O$), also known as calcined gypsum to form an aqueous gypsum slurry, and thereafter allowing the slurry mixture to hydrate or set into calcium sulfate dihydrate ($CaSO_4.2H_2O$), a relatively hard material. The core of the product will in general comprise at least about 85 wt. percent of set gypsum, though the invention is not limited to any particular content of gypsum in the core.

The composition from which the set gypsum core of the structural panel is made can include a variety of optional additives, including, for example, those included conventionally in gypsum wallboard. Examples of such additives include set accelerators, set retarders, foaming agents, reinforcing fibers, and dispersing agents.

A preferred gypsum core of the present invention also includes one or more additives, which improve the water-resistant properties of the core. In particular, the coated fibrous mat-faced gypsum board for use in the present invention preferably comprises a gypsum core, which has water-resistant properties. The preferred means for imparting water-resistant properties to the gypsum core is to include in the gypsum composition from which the core is made one or more additives, which improve the ability of the set gypsum composition to resist being degraded by water, for example, to resist dissolution. In preferred form, the water-resistance of the coated board is such that it absorbs less than about 10%, preferably less than about 7.5%, and most preferably less than about 5% water when tested in accordance with the immersion test of ASTM method C-473.

Examples of materials which have been reported as being effective for improving the water-resistant properties of gypsum products are the following: poly(vinyl alcohol), with or without a minor amount of poly(vinyl acetate); metallic resinates; wax or asphalt or mixtures thereof, usually supplied as an emulsion; a mixture of wax and/or asphalt and also cornflower and potassium permanganate; water insoluble thermoplastic organic materials such as petroleum and natural asphalt, coal tar, and thermoplastic synthetic resins such as poly(vinyl acetate), poly(vinyl chloride) and a copolymer of vinyl acetate and vinyl chloride and acrylic resins; a mixture of metal rosin soap, a water soluble alkaline earth metal salt, and residual fuel oil; a mixture of petroleum wax in the form of an emulsion and either residual fuel oil, pine tar or coal tar; a mixture comprising residual fuel oil and rosin; aromatic isocyanates and diisocyanates; organohydrogenpolysiloxanes; siliconates, such as available from Dow Corning as Dow Corning 772; a wax emulsion and a wax-asphalt emulsion each with or without such materials as potassium sulfate, alkali and alkaline earth aluminates, and Portland cement; a wax-asphalt emulsion prepared by adding to a blend of molten wax and asphalt an oil-soluble, water-dispersing emulsifying agent, and admixing the aforementioned with a solution of case in which contains, as a dispersing agent, an alkali sulfonate of a polyarylmethylene condensation product. Mixtures of these additives can also be employed.

Materials that have been used widely in improving the water-resistant properties of the gypsum core of wallboard comprise wax emulsions and wax-asphalt emulsions, species of which are available commercially. The wax portion of these emulsions is preferably a paraffin or microcrystalline wax, but other waxes also can be used. The asphalt in general should have a softening point of about 115° F., as determined by the ring and ball method. The total amount of wax and wax-asphalt in the aqueous emulsions will generally comprise about 50 to about 60 wt. percent of the aqueous emulsion. In the case of wax-asphalt emulsions, the weight ratio:of asphalt to wax usually varies from about 1 to 1 to about 10 to 1. Various methods are known for preparing wax-asphalt emulsions, as reported in U.S. Pat. No. 3,935,021 to D. R. Greve and E. D. O'Neill, incorporated herein by reference. Commercially available wax emulsions and wax-asphalt emulsions that can be used in the composition described herein have been sold by United States Gypsum Co. (Wax Emulsion), by Monsey Products (No. 52 Emulsion), by Douglas Oil Co. (Docal No. 1034), by Conoco (No. 7131 and GYPSEL II) and by Monsey-Bakor (AUUALITE 70). The amount of wax emulsion or wax-asphalt emulsion used to provide water resistant characteristics to the gypsum core can be within the range of about 3 to about 10 wt. %, preferably about 5 to about 7 wt. %, based on the total weight of the ingredients of the composition from which the set gypsum core is made, the ingredients including the water of the wax or wax-asphalt emulsion, but not including additional amounts of water that are added to the gypsum composition for forming an aqueous slurry thereof.

A mixture of materials, namely, one or more of poly(vinyl alcohol), siliconates, wax emulsion and wax-asphalt emulsion of the aforementioned types, for example, can be used to improve the water resistance of gypsum products, such as described in aforementioned U.S. Pat. No. 3,935,021. The source of the poly(vinyl alcohol) is preferably a substantially completely hydrolyzed form of poly(vinyl acetate), that is, about 97 to 100% hydrolyzed polyvinyl acetate. The poly (vinyl alcohol) should be cold-water insoluble and soluble in water at elevated temperatures, for example, at temperatures of about 140° to about 205° F. In general, a 4 wt. % water solution of poly(vinyl alcohol) at 20° C. will have a viscosity of about 25 to 70 cp as determined by means of the Hoeppler falling ball method. Poly(vinyl alcohols) for use in the composition of the present invention have been available commercially, such as from E.I. du Pont de Nemours and Company, sold under the trademark "Elvanol" and previously from Monsanto Co., sold under the trademark "Gelvatol". Examples of such prior-available products are Elvanol type poly(vinyl alcohols) Grades 71-30, 72–60, and 70-05, and Gelvatol type poly(vinyl alcohols). Grades 1-90, 3-91, 1–60, and 3-60. Air Products Corp. also has soled a product identified as WS-42. There are many additional commercial sources of poly(vinyl alcohol).

The amounts of poly(vinyl alcohol) and wax-asphalt emulsion or wax emulsion used should be at least about 0.05 wt. % and about 2 wt. % respectively. The preferred amounts of poly(vinyl alcohol) and wax or wax-asphalt emulsion are about 0.15 to about 0.4 wt. % and about 3 to about 5 wt. %, respectively. The siliconates are normally used in an amount of from about 0.05% to about 0.4%, more usually in an amount of about 0.1%. Unless stated otherwise, the term "wt. %" when used herein and in the claims in connection with the gypsum core means weight percent based on the total weight of the ingredients of the composition from which the set gypsum core is made, said ingredients including the water of the wax or wax-asphalt emulsion, but not including additional amounts of water that are added to the gypsum composition for forming an aqueous slurry thereof.

Another preferred water-resistant additive for use in the core of the gypsum-based core is an organopolysiloxane, for example, of the type referred to in U.S. Pat. Nos. 3,455,710; 3,623,895; 4,136,687; 4,447,498; and 4,643,771. Within this class of materials, poly(methyl-hydrogen-siloxane) is particularly preferred. The amount of the organopolysiloxane should be at least about 0.2 wt. %. A preferred amount falls within the range of about 0.3 to about 0.6 wt %.

Typically, the core of fibrous mat-faced gypsum board has a density of about 40 to about 55 lbs. per cu. ft., more usually about 46 to about 50 lbs per cu. ft. Of course, cores having both higher and lower densities can be used in particular applications if desired. The manufacture of cores of predetermined densities can be accomplished by using known techniques, for example, by introducing an appropriate amount of foam (soap) into the aqueous gypsum slurry from which the core is formed or by molding.

In accordance with the present invention, the surface of the core of the gypsum board is faced with a coated fibrous mat. The coating of the fibrous mat is basically impervious to liquid water. The coating should be sufficiently porous, however, to permit water in the aqueous gypsum slurry from which the gypsum core is made to evaporate in its vaporous state therethrough during manufacture of the board. In this way, the coated mat can be prepared in advance and used in making the mat faced board. The coated fibrous mat-faced gypsum board can be made efficiently as is well known by forming an aqueous gypsum slurry which contains excess water and placing the gypsum slurry on a horizontally oriented moving web of the coated fibrous mat. In a preferred embodiment, another moving web of the coated fibrous mat is then placed on the upper free surface of the aqueous gypsum slurry. Aided by heating, excess water evaporates through the coated mat as the calcined gypsum hydrates and sets.

The fibrous mat comprises material that is capable of forming a strong bond with the set gypsum comprising the core of the gypsum board. Examples of such materials include (1) a mineral-type material such as glass fibers and (2) synthetic resin fibers. Glass fiber mats are preferred. The mat can comprise continuous or discrete strands or fibers and can be woven or nonwoven in form. Nonwoven mats such as made from chopped strands and continuous strands can be used satisfactorily and are less costly than woven materials. The strands of such mats typically are bonded together to form a unitary structure by a suitable adhesive. The fiber mat can range in thickness, for example, from about 10 to about 40 mils, with a mat thickness of about 15 to about 35 mils generally being suitable. The aforementioned fibrous mats are known and are commercially available in many forms.

One suitable fibrous mat is a fiberglass mat comprising chopped, nonwoven, fiberglass filaments oriented in a random pattern and bound together with a resin binder, typically a urea-formaldehyde resin adhesive. Fiber glass mats of this type are commercially available, for example, such as those which have been sold under the trademark DURA-GLASS by Manville Building Materials Corporation and those which have been sold by Elk Corporation as BUR or shingle mat. An example of such a mat, which is useful in preparing a coated mat for making gypsum board useful in structural building applications, is nominally 33 mils thick and incorporates glass fibers about 13 to 16 microns in diameter. Although certain structural applications may utilize a thicker mat and thicker fibers, a glass fiber mat nominally 20 mils thick, which includes glass fibers about 10 microns in diameter, is also suitable for use in the present invention.

Mats suitable for making coated mat useful in the present invention have a basis weight, which is usually between about 10 and 30 lbs. per thousand square feet of mat surface area Typically, but not exclusively, the glass fiber mats used as the base substrate of the coated mat used in this invention are wet-formed into a continuous non-woven web of any workable width on a Fourdrinier-type machine. Preferably, an upwardly inclining wire having several linear feet of very dilute stock lay-down, followed by several linear feet of high vacuum water removal, is used. This is followed by a "curtain coater," which applies the glass fiber binder and an oven that removes excess water and cures the adhesive to form a coherent mat structure.

The coating composition, which is applied to one surface of the above-described fiber mat for making the coated mat for use in the present invention, comprises an aqueous combination of predominately a mineral pigment; a first binder of a polymer latex adhesive; and, a second binder of an inorganic adhesive. On a dry weight basis, the first binder comprises no more than about 5.0% by weight, and the second binder comprises at least about 0.5% by weight, of the total weight of the dried (cured) coating. The weight ratio of the mineral pigment to the polymer latex adhesive first binder can be in excess of 15:1 and in some cases can be in excess of 20:1. Suitable coating compositions for making coated mat useful in the present invention thus may contain, on a dry weight basis, about 75 to 98 percent mineral pigment, more usually about 85 to 95 percent mineral pigment, about 0.5 to 20 percent inorganic adhesive, more usually about 0.5 to 10 percent and about 0.1 to 5 percent polymer latex adhesive, more usually about 1 to 5 percent. Any suitable method for applying an aqueous coating composition to a substrate can be used for making the coated mat. Following application of the aqueous coating composition to the mat the composition is dried (cured), usually by heat to form the coated mat. The coated mat made in accordance with these teachings is liquid impermeable, but does allow water vapor to pass through.

A mineral pigment comprises the major component of the coating composition. Examples of mineral pigments suitable for making coated mats useful in the present invention include, but are not limited to, ground limestone (calcium carbonate), clay, sand, mica, talc, gypsum (calcium sulfate dihydrate), aluminum trihydrate (ATH), antimony oxide, or a combination of any two or more of these substances. The mineral pigment is usually provided in a particulate form. To be an effective mineral pigment for making a coated mat for use in this invention, the pigment should have a particle size such that at least about 95% of the pigment particles pass through a 325 mesh wire screen. Such materials are collectively and individually referred to in the alternative as mineral pigments or as "fillers" throughout the remainder of this application.

Examples of inorganic adhesive binders which are used in combination with the polymer adhesive latex binders in the coating compositions for making coated fibrous mats useful in this invention include, but are not limited to the following: calcium oxide, calcium silicate, calcium sulfate, magnesium oxychloride, magnesium oxysulfate, and other complex inorganic binders of some Group IIA elements (alkaline earth metals), as well as aluminum hydroxide.

One example of a complex inorganic binder is common Portland cement, which is a mixture of various calcium-aluminum silicates. However, Portland cement cures by hydration, which can create a coating mixture with a short shelf life. Also, both the oxychloride and the oxysulfate of magnesium are complex inorganic binders, which cure by hydration. Coating formulations made with such inorganic adhesive binders must be used quickly or a tank containing the aqueous coating composition could set up in a short period of time.

The oxychlorides or oxysulfates of magnesium, aluminum hydroxide, and calcium silicate are only very slightly soluble in water, and are useful inorganic adhesive binders of this invention. Inorganic adhesive binders, which are quickly soluble in water, such as sodium silicate, may not be usable in coatings expected to be exposed to hot and/or high humid ambient conditions for long periods. One preferred inorganic adhesive binder for making a coated mat useful in this invention is quicklime (CaO). Quicklime does not hydrate in a coating mix, but cures by slowly converting to limestone, using carbon dioxide from the air. Quicklime is not soluble in water.

Filler materials inherently containing some naturally occurring inorganic adhesive binder can be used to make the coated mat used in the present invention. Examples of such fillers, some listed with the naturally occurring binder, include (but are not limited to) the following: limestone containing quicklime (CaO), clay containing calcium silicate, sand containing calcium silicate, aluminum trihydrate containing aluminum hydroxide, cementitious fly ash and magnesium oxide containing either the sulfate or chloride of magnesium, or both. Depending on its level of hydration, gypsum can be both a mineral pigment and an inorganic adhesive binder, but it is only slightly soluble in water, and the solid form is crystalline making it brittle and weak as a binder. As a result, gypsum is not generally preferred for use as the inorganic adhesive binder.

Fillers, which inherently include an inorganic adhesive binder as a constituent and which cure by hydration, also advantageously act as flame suppressants. As examples, aluminum trihydrate (ATH), calcium sulfate (gypsum), and the oxychloride and oxysulfate of magnesium all carry molecules of water bound into their molecular structure. This water, referred to either as water of crystallization or water of hydration, is released upon sufficient heating, actually suppressing flames.

Low cost inorganic mineral pigments such with the properties of those described in the preceding paragraph, thus, provide three (3) important contributions to the coating mixture: a filler; a binder; and, a fire suppressor.

Examples of polymer latex binders used with the inorganic binders include, but are not limited to: styrene-butadiene-rubber (SBR), styrene-butadiene-Styrene (SB 5), ethylene-vinyl-chloride (EVCl), poly-vinylidene-chloride (PVdC), modified poly-vinyl-chloride (PVC), poly-vinyl-alcohol (PVOH), ethylene-vinyl-actate (EVA), styrene-acrylic copolymer, poly(vinylidene) copolymer and poly-vinyl-acetate (PVA). No asphalt is used as a binder in making a coated mat useful in this invention. In order for the coated mat to be most useful in making the coated mat-faced gypsum board of the present invention, it is preferred that the coated mat be rolled up into rolls of continuous sheet. As a result, the coated mat cannot be so stiff and brittle that it will break upon bending. To accomplish this objective, it appears that the inorganic adhesive binder content of the mat coating should not exceed about 20% by weight of the total dry weight of the coating, and usually is less than 10%. Likewise, the polymer latex binder has practical upper limits due to cost and a desire to limit the combustibility of the coating. No more than about 5.0% latex (dry weight basis)

of the total dry weight of the coating appears necessary. Rolls of a coated glass fiber mat suitable for making the coated mat faced gypsum board of the present invention has been obtained from Atlas Roofing Corporation as Coated Glass Facer (CGF).

Further details concerning coating compositions suitable for making coated fiber mat, and particularly coated glass fiber mat, useful for making the coated fibrous mat-faced gypsum board structural panels of the present invention can be obtained from U.S. Pat. No. 5,112,678, the entire disclosure of which is incorporated herein by reference.

The amount of coating applied to the surface of the fibrous mat should be sufficient to embed the mat completely in the coating, to the extent that substantially no fibers protrude through the coating. The amount of coating required is dependent upon the thickness of the mat. Using a glass fiber mat nominally 33 mils thick (made using fibers of about 16 microns), the amount of coating when dried should be equivalent to at least about 50 lbs., preferably about 100 lbs. per 1000 sq. ft. of mat surface area; using a fiber glass mat nominally 20 mils thick (made with fibers of about 10 microns), a lesser amount of coating may be used. Although higher or lower amounts of coating can be used in any specific case, it is believed that, for most applications, the amount of coating will fall within the range of about 50 to about 120 lbs per 1000 sq. ft. of mat (dry basis). In particularly preferred form, applied to 33 mil mat, the dry coating should weigh about 60 to about 80 or 100 lbs. per 1000 sq. ft. of board; applied to 20 mil mat, the dry coating may weigh about 80 lbs. per 1000 sq. ft. of board.

With respect to the thickness of the coating, it is difficult to measure thickness because of the uneven nature of the fibrous mat substrate on which the coating is applied. In rough terms, the thickness of the coating should be at least about 10 mils, but when the glass mat is relatively thin and the coating is efficiently dried, a coating as thin as 4 mils may suffice. In general, the thickness need not exceed about 30 mils.

The coating composition can be applied by any suitable means to the fibrous mat, for example, spray, brush, curtain coating, and roller coating, the last mentioned being preferred. The amount of wet (aqueous) composition applied can vary over a wide range. It is believed that amounts within the range of about 90 or 100 to about 150 or 180 lbs. per 1000 sq. ft. of mat will be satisfactory for most applications.

Figure 3:
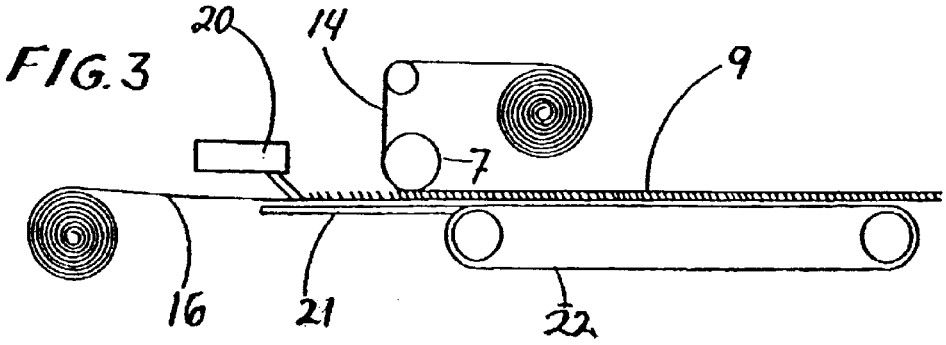
FIG. 3 shows a highly schematic view of an apparatus for making the coated mat faced gypsum board of the present invention.

The moisture tolerant structural panels of this invention comprising a coated fibrous mat-faced gypsum board can be made utilizing an existing, manufacturing line for gypsum wallboard as illustrated in FIG. 3. In conventional fashion, dry ingredients from which the gypsum core is formed are pre-mixed and then fed to a mixer of the type commonly referred to as a pin mixer 20. Water and other liquid constituents, such as soap, used in making the core are metered into the pin mixer where they are combined with the desired dry ingredients to form an aqueous gypsum slurry. Foam (soap) is generally added to the slurry in the pin mixer to control the density of the resulting core. The slurry is dispersed through one or more outlets at the bottom of the mixer onto a moving sheet 16, which is indefinite in length and is fed from a roll thereof onto a forming table 21 and advanced by conveyor 22. The sheet forms one of the facing sheets of the board. In preferred form, the sheet is a coated fibrous mat of the type useful in accordance with the present invention and the same as the one that is applied subsequently to the top of the slurry. The slurry penetrates into the thickness of the coated glass mat. On setting, a strong adherent bond is formed between the set gypsum and the mat. In part because of the coating on the surface of the neat, the slurry does not penetrate through the mat completely.

As is common practice in the manufacture of conventional paper-faced gypsum board, the two opposite edge portions of the sheet are progressively flexed upwardly from the mean plane thereof and then turned inwardly at the margins as to provide coverings for the edges of the resulting board. One of the benefits of the coated mat used in connection with the present invention is that it has shown sufficient flexibility to form acceptable board edges Another sheet of the coated fibrous mat 14 also supplied in roll form, as defined in detail above, is fed around a roller 7 onto the top of the forming sheet 9, thereby sandwiching the gypsum slurry between the two moving glass fiber sheets which form the facings of the set gypsum core which is formed from the gypsum slurry. A strong bond also is formed between this mat and the gypsum core as previously described. Conventional shaping rolls and edge guiding devices are used to shape and maintain the edges of the composite until the gypsum has set sufficiently to retain its shape.

Although improvements can be realized by the use of a gypsum core which has but one of its surfaces faced with the coated fibrous mat as described herein, it is believed that, for many applications, it will be most advantageous to manufacture board having both surfaces faced with the coated fibrous mat. Indeed, it is preferred that both surfaces of the core be faced with substantially the same coated fibrous material. If the surfaces of the core are faced with materials that have different coefficients of expansion, the core tends to warp. Fibrous mat-faced gypsum board and methods for making the same are known, for example, as described in aforementioned U.S. Pat. No. 4,647,496 and in Canadian Patent No. 993,779 and U.S. Pat. No. 3,993,822. The weight of the coated board (½") usually should not exceed about 2500 lbs. per 1000 sq. ft. Typically, the coated board will weigh at least about 1900 lbs. per 1000 sq. ft.

The ability of the coated fibrous mat used in the present invention to the pass water vapor therethrough is an important feature of the present invention and is such that the drying characteristics of the board are not substantially altered relative to a board faced with conventional paper facing. This means that industrial drying conditions typically used in continuous gypsum board manufacture also can be used in the manufacture of coated mat-faced board of the present invention. Exemplary drying conditions include temperatures of about 200° to about 600° F., with drying times of about 30 to about 60 minutes, at line speeds of about 70 to about 400 linear feet per minute.

In another preferred embodiment of the present invention, following the initial preparation of the coated fibrous mat-faced gypsum board, a separate water-resistant coating of the type described in U.S. Pat. No. 5,397,631, the disclosure of which is incorporated herein by reference, also can be applied to one, or both of the coated facers to make the doubly-coated surface also impervious to the passage of water vapor. This additional coating is applied onto the surface of the coated fibrous mat, now bonded to the set gypsum core, as an aqueous coating composition comprising from about 15 to about 35 wt. % of resin solids, about 20 to about 65 wt. % of filler, and about 15 to about 45 wt. % of water. One resin suitable for use in the coating composition is available in the form of a latex, as previously sold by Unocal Chemicals Division of Unocal Corporation under the mark 76 RES 1018. The pH and solids content of the latex are respectively 7.5-9.0 and 50%. The resin is a styrene-acrylic copolymer that has a relatively low film-forming temperature (20° C.) and a glass transition temperature, Tg of 22° C. Coatings formed from the resin can be dried effectively at temperatures within the ranges of about 300 to 400° F. Another suitable resin for the coating is a poly (vinylidene) copolymer. Still another reinforcing resin binder suitable for use in this embodiment of the present invention also has been available in the form of a latex sold by Unocal Chemicals Division of Unocal Corporation—under the mark 76 RES 2302. The pH and solids content of the latex are, respectively, 3.5 and 45%. The resin is a self-crosslinking vinyl acetate-acrylic copolymer that has a Tg of about 33° C. Other suitable resins will be apparent to those skilled in the art. Examples of fillers that can be used in making the aqueous coating composition are silicates, silica, gypsum and calcium carbonate, the last mentioned being particularly preferred. Other conventional additives of the type generally used in latex paint compositions also can be added to this coating composition. In general, the total amount of such additives will be within the range of about 1 to about 5 wt. %. Examples of such additives include pigments, thickeners, defoamers, dispersants and preservatives.

In making the prior art coated board according to U.S. Pat. No. 5,397,631 at least about 50 lbs., and preferably between about 60 and 100 lbs., on the basis of coating solids, per 1000 sq. ft. of board, of the aqueous composition has been applied to the surface of the board thereby forming on said surface a wet film of said composition, and the wet film then being dried to form the water-resistant resinous coating. In connection with the present invention, much lower coating weights can be used to obtain an equivalent vapor impervious coating. In particular, a weight reduction of over 60% is possible while obtaining equivalent vapor-barrier performance. Thus, in making a vapor impervious board using this technology, between about 15 and 40 pounds, and more usually between about 20 and 30 pounds of the solids of the aqueous composition is applied per 1000 sq. ft. of board.

Coated board of the present invention can be used effectively in many outdoor and indoor applications in addition to those previously mentioned. For example, the coated board can be used in applications of the type where conventional gypsum sheathing is applied as a support surface for overlying materials such as wood siding, stucco, synthetic stucco, aluminum, brick, including thin brick, outdoor tile, stone aggregate and marble. Some of the aforementioned finishing materials can be used advantageously in a manner such that they are adhered directly to the coated board. The coated board can be used also as a component of exterior insulating systems, commercial roof deck systems, and exterior curtain walls. In addition, the coated board can be used effectively in applications not generally involving the use of paper-faced gypsum board. Examples of such applications include walls associated with saunas, swimming pools, and gang showers.

When used as a tile backer in bathroom applications, any suitable mastic can be used to adhere tiles or other materials to the coated fibrous mat-faced board. Some of the adhesives include alkalis, which tend to degrade glass fibers. The coating on the mat used in the present invention functions to protect the glass fibers from degradation by such adhesives, and accordingly, offers the user the flexibility of being usable with various types of adhesives or mastic. Type I mastic should prove effective. However, dry-set mortars and mortars made from latex/Portland cement can be used also. The mastic can be applied using conventional means, for example, with a notched applicator. Joints and corners of the board should be taped according to the usual means, for example, with a 2" woven glass mesh tape.

The example that follows is illustrative, but is not to be limiting of the invention.

EXAMPLE

A coated fiberglass mat was obtained from Atlas in roll form and was used to prepare gypsum board panels. The coated mat was prepared from an uncoated mat having a basis weight of about 2.65 pounds per 100 square feet. The substrate mat was composed of glass fiber filaments, nominally 13 microns in diameter, oriented in a random pattern bonded together by an adhesive believed to be a urea-formaldehyde resin. The coated mat had a thickness of about 25 mils and had substantially the same permeability to water vapor as the paper of the type commonly used as the cover sheet of gypsum wallboard.

Continuous length board was made from a gypsum slurry containing about 55% percent by weight of gypsum hemihydrate and the coated Atlas mat on a conventional wallboard machine. The slurry was deposited on one continuous sheet of the coated mat, which was advanced at a rate of 120 linear feet per minute, sufficient to form a one inch thick board, while another continuous sheet of the coated mat was deposited onto the opposite surface of the gypsum slurry. Drying of the gypsum board was accelerated by heating the composite structure in an oven at about 400° F. for about thirty minutes and until the board is almost dry and then at about 250° F. for about fifteen minutes until it is dried completely. The density of the coated mat-faced board was determined to be about 47 lb. per cu. ft.

The coated mat-faced gypsum board made in accordance with the present invention is capable of resisting for indefinite periods of time attack by water, both in indoor and outdoor applications, and to offer significantly enhanced fire resistance. In summary, it can be said that the improved gypsum-based product of the present invention has water-tolerant properties which are at least equal to or better than prior art products, and that this is achieved in a product that is obtained in a product that is as light as and more economical to make than prior art products.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention, which is limited only by the appended claims.

We claim:

1. A moisture-tolerant structural panel made by (1) contacting a gypsum slurry for forming a gypsum core with (2) a first surface of a coated mat comprising fibers to adhere said fibers of said first surface of said coated mat to at least one surface of said gypsum core;

the coated mat having a coating on a second surface comprising a combination of (i) a mineral pigment, (ii) an inorganic adhesive binder and (iii) a polymer latex adhesive binder, and (3) allowing the gypsum slurry to harden, wherein said coated mat has a porosity which allows water to evaporate from the gypsum core during preparation of the panel.

2. A panel according to claim 1 wherein said coated mat contains glass fibers nominally about 10 to 16 microns in diameter.

3. A panel according to claim 2 in which said coated mat, in the absence of said coating, has a basis weight of 10 to 30 pounds per 1000 square feet.

4. A panel according to claim 1 wherein said gypsum core has density of 40 to 55 pounds per cubic foot.

5. A panel according to claim 1 wherein the coating weighs about 50 to 120 pounds per 1000 square feet of coated mat.

6. A panel according to claim 5 wherein the mineral pigment comprises from about 75 to 98 weight percent of the coating, the inorganic adhesive binder comprises from about 0.05 to 20 weight percent of the coating and the polymer latex adhesive binder comprises from about 0.1 to 5 weight percent of the coating.

7. A panel according to claim 5 wherein the mineral pigment comprises from about 85 to 95 weight percent of the coating, the inorganic adhesive binder comprises from about 0.5 to 10 weight percent of the coating and the polymer latex adhesive binder comprises from about 1 to 5 weight percent of the coating.

8. A moisture-tolerant structural panel made by (1) contacting a gypsum slurry for forming a set gypsum core between two mats of glass fibers, wherein a free surface of one of said mats is coated with a combination of(i) a mineral pigment, (ii) an inorganic adhesive binder and (iii) a polymer latex adhesive binder applied to said surface as an aqueous coating composition to form a coated glass mat, said combination containing no more than about 5 wt. % polymer adhesive solids, said aqueous coating composition upon drying and setting, covering said mat to the extent that substantially none of the fibers of said mat protrude from said coating, and (2) allowing the gypsum slurry to harden, wherein the set gypsum core includes a water-resistant additive in an amount sufficient to improve the water-resistant properties of said core, and wherein said coated mat has a porosity which allows water to evaporate from the gypsum core during preparation of the panel.

9. A panel according to claim 8 wherein said aqueous coating composition comprises (1) on a solids basis at least about 75% by weight of the mineral pigment, from 0.05 to 20% by weight of the inorganic adhesive binder and no more than about 5.0% the polymer latex adhesive binder and (2) water.

10. A panel according to claim 9 wherein said composition includes about 1 to about 5 wt. % of one or more additives selected from the group consisting of a thickener, dispersant, pigment, defoaming agent and preservator.

11. A panel according to claim 9 wherein said coating is present in an amount equivalent to no more than about 100 lbs. per 1000 sq. ft. of the mat.

12. A panel according to claim 11 in which said mat, in the absence of said coating, has a basis weight of 10 to 30 pounds per 1000 square feet.

13. A panel according to claim 9 wherein the amount of said water-resistant additive is at least about 0.2 wt. %.

14. A panel according to claim 9 wherein the amount of said water-resistant additive is about 0.3 to about 10 wt. %.

15. A panel according to claim 9 wherein said additive is selected from the group consisting of a wax emulsion, a wax-asphalt emulsion, poly(vinyl alcohol), a polysiloxane, a siliconate and mixtures thereof.

16. A panel according to claim 9 wherein the polymer latex adhesive binder of said coating consists essentially of a styrene-acrylic copolymer.

17. A panel according to claim 9 wherein the polymer latex adhesive binder of said coating consists essentially of a poly(vinylidene) copolymer).

18. The structural panel of claim 9 having a ½" board weight not exceeding about 2,500 lbs. per 1,000 cu. ft.

19. The structural panel of claim 9 having an additional water-resistant coating comprising a dried coating of a composition containing from about 15 to about 35 wt. % of resin solids, about 20 to about 65 wt. % of filler solids, and about 15 to about 45 wt. % of water, said composition being applied to said coated glass mat to provide between about 15 and 40 pounds of solids per 1000 square feet of panel.

20. The structural panel of claim 19 wherein said resin is selected from a styrene-acrylic copolymer latex, a poly (vinylidene) copolymer and a vinyl-acetate-acrylic copolymer latex and said composition is applied to said coated glass mat to provide between about 20 and 30 pounds of solids per 1000 square feet of panel.

* * * * *

UNITED STATES PATENT AND TRADEMARK OFFICE

CERTIFICATE OF CORRECTION

PATENT NO. : 6,808,793 B2
DATED : October 26, 2004
INVENTOR(S) : Brian G. Randall et al.

It is certified that error appears in the above-identified patent and that said Letters Patent is hereby corrected as shown below:

Title page,
Item [*] Notice, please insert -- This patent is subject to a terminal disclaimer --.

Column 7,
Line 18, please replace "GYPSEL" with -- GYPSEAL --.
Line 19, please replace "AUUALITE' with -- AQUALITE --.
Lines 48 and 49, please replace "poly(vinyl alcohols)" with -- poly(vinyl alcohols), --
Line 49, please replace "poly(vinyl alcohols)." with -- poly(vinyl alcohols), --

Column 10,
Line 50, please replace "styrene-butadiene-Styrene (SB 5)" with -- styrene-butadiene-styrene (SBS) --

Signed and Sealed this

Fourteenth Day of June, 2005

JON W. DUDAS
*Director of the United States Patent and Trademark Office*